US006704961B2

(12) United States Patent
Kienlein

(10) Patent No.: US 6,704,961 B2
(45) Date of Patent: Mar. 16, 2004

(54) SUPPORT FOR THE CORPUS OF A LYING OR SITTING PERSON

(76) Inventor: Kurt Kienlein, Rosenthal 2, 90552, Rothenbach (DE)

( * ) Notice: Subject to any disclaimer, the term of this patent is extended or adjusted under 35 U.S.C. 154(b) by 0 days.

(21) Appl. No.: 10/154,808

(22) Filed: May 28, 2002

(65) Prior Publication Data

US 2002/0178505 A1 Dec. 5, 2002

(30) Foreign Application Priority Data

May 29, 2001 (EP) ..... 01113117

(51) Int. Cl.[7] ..... A47C 27/00
(52) U.S. Cl. ..... 5/730; 5/731; 5/740; 5/724
(58) Field of Search ..... 5/730, 731, 724, 5/740, 655.9, 646, 657; 606/240

(56) References Cited

U.S. PATENT DOCUMENTS 4,267,611 A * 5/1981 Agulnick ..... 5/713
4,383,342 A 5/1983 Forster
4,785,801 A 11/1988 Speece
4,876,755 A * 10/1989 Parrish ..... 297/284.3
4,967,433 A * 11/1990 Neal ..... 5/655.9
5,007,124 A * 4/1991 Raburn et al. ..... 5/731
5,742,963 A * 4/1998 Trevino et al. ..... 5/632

FOREIGN PATENT DOCUMENTS

EP 0 036 158 A1 5/1983
GB 2 197 785 A 6/1988

* cited by examiner

*Primary Examiner*—Teri Luu
*Assistant Examiner*—Fredrick Conley
(74) *Attorney, Agent, or Firm*—Bacon & Thomas, PLLC

(57) ABSTRACT

A support for the body of a lying or sitting person, including a formed structure of a permanently flexible material, comprising a bottom part (9) that has a head end (12) and an opposing foot end (10), and from which several ribs (11) arranged side-by-side protrude towards the upper side running approximately transversely to the longitudinal center line (7) of the support (1) and being inclined, in the side view, towards the head end (12). The support (1) is characterized in that said ribs (11) are arranged in an arrow shape, and form with the longitudinal center line (7) an angle α larger than 90° towards the head end (12). The support (1) provides an improved and at the same time relieving tensile effect in particular for the vertebral column and hence the intervertebral disks of a person to be treated.

13 Claims, 4 Drawing Sheets

SUPPORT FOR THE CORPUS OF A LYING OR SITTING PERSON

DESCRIPTION

BACKGROUND

A. Field

The invention relates to a support for the body of a lying or sitting person, comprised of a formed structure of a permanently flexible material, comprising a bottom part that has a head end and an opposing foot end, and from which several ribs arranged side-by-side protrude towards the upper side running approximately transversely to the longitudinal center line of the support and being inclined, in the side view, towards the head end.

B. Related Art

Such a support is, for example, described in the document EP-A-0 036 158. The ribs of this known support run transversely and hence perpendicular to the longitudinal center line of the support, and are inclined towards the head end, so that they point obliquely into the direction of the head.

There, a support for a lying person is also described, wherein that zone of the support exhibiting the mentioned ribs, is subdivided into two zones, namely into a dorsal zone and a nates zone. The ribs in the dorsal zone thereby point obliquely into the direction of the head, whereas the ribs in the nates zone point obliquely into the direction of the legs. All of these ribs, however, run strictly perpendicular to the longitudinal center line of the support, and hence continuously in parallel to each other.

From the document EP-A-0 442 999, a seat support is known that has ribs similar to the above-described support. The ribs or ridges described there, however, have on their upper free ends protrusion or "lobes" extending approximately horizontally and hence approximately in parallel to the bottom part. The document GB-A-2197785 includes a similar teaching.

All of these seat supports have in common that the inclination of the ribs increases under the weight of the person to be rested, whereby a stretching effect is exerted on the body of the person concerned. In other words, the vertebral column and hence the intervertebral disks are relieved. However, all of these known seat supports exert only just a traction towards the head end or to the foot end.

BRIEF SUMMARY OF THE INVENTION

It is the object of the present invention to provide a support of the mentioned kind disposing of an improved, and at the same time of a relieving, tensile effect.

This task is solved by a support characterized in that the ribs are arranged in an arrow shape, and form with the longitudinal center line an angle $\alpha>90°$ towards the head end.

The ribs of the inventive support therewith do not run perpendicular to the longitudinal center line, but in an angle $\alpha$. This angle $\alpha$ is embraced between the longitudinal center line and each of the ribs on the side pointing towards the head end. Thus, the ribs form a kind of arrow, the head of which lies on the longitudinal center line and points towards the head end. This angle $\alpha$ hence is enclosed between the longitudinal axis of each rib approximately pointing into the traverse direction to the support, and the longitudinal center line. The longitudinal center line therewith subdivides that zone of the support provided with the ribs of the described kind into a left zone and into a right zone, in each of which the ribs run differently to the longitudinal center line and result in the mentioned arrow shape. Moreover, with the inventive support, the entire support need not be provided with the depicted ribs. The support, on the contrary, can, for example, feature at its outer edges, a zone without such ribs; the ribs then are situated in the central zone of the support. Preferably, however, the entire support surface of the inventive support is provided with the depicted ribs.

By the described arrangement of the rips with an angle a tension or pulling force, respectively, is applied not exactly in the direction of the longitudinal center line but inclined thereto.

In other words, the tensile relief for a person rested on the support is not effected just into the direction of the head but starting from the vertebral column approximately into the direction of the shoulders. Thus, not only an improved tensile relief for the vertebral column and the intervertebral disks can be achieved, further positive effects can rather be obtained, as well. It has, for example, turned out that in a treatment involving the inventive support, the pulmonary volumes of patients can be increased. This is of a particular interest for asthmatic patients. Surprisingly, even new-born babies and geriatric patients can efficiently be treated in various pathological manifestations using the inventive support.

The angle $\alpha$ of the successive ribs moreover can increase from the foot end towards the head end. This means that the arrow becomes more and more acute towards its head end. Thus, the ribs of course will no longer run strictly in parallel, rather somewhat obliquely to each other.

According to a preferred embodiment, however, the angles a of all ribs are of the same size. The ribs thereby run mutually parallel on each side of the longitudinal center line.

According to a further preferred embodiment, the angle $\alpha$ is 95° up to 120°.

The inventive support can constitute, according to an inventive variant, a dorsal rest for a seated person. In this event, the angle a of all ribs is preferably larger than 90°, so that the entire support zone has the described arrow-shaped ribs. For avoiding misunderstandings, it is pointed out that the ribs need not abut against each other at the longitudinal center line, rather can also be mutually staggered. Preferably, however, they will abut there against each other.

When the inventive support constitutes a dorsal rest, then the rib height preferably decreases from the center, for one, towards the head end and, for another, towards the foot end. In this case, the foot end as such would rather have to be designated as a nates end, since a dorsal rest for a seated person cannot protrude beyond the nates. For reasons of a simplified terminology, however, said term "foot end" will be used for this embodiment, as well.

When the inventive support constitutes an orthopedic or therapeutic mat, then it is preferably subdivided into two zones, namely into a dorsal zone pointing towards the head end, and into a nates zone pointing towards the foot end. A person rested by means of such a mat hence lies upon the dorsal zone with his back, and upon the nates zone with his buttocks.

Viewed in the top view, the ribs, in the dorsal zone, form with the longitudinal center line an angle $\alpha>90°$ towards the head end, so that in said dorsal zone the depicted arrow shape is realized. The ribs are thereby inclined towards the head end as has been described above. In the nates zone, however, the ribs do not have an arrow shape towards the head end, rather can be perpendicular to the longitudinal center line and inclined towards the foot end. In this embodiment,, the ribs hence have a shape and configuration in the nates zone which has already been described in the prior art.

According to a preferred embodiment, however, the ribs in the nates zone have, likewise viewed in the top view, an arrow shape, whereby said arrow, however, does not point towards the head end, rather it points towards the foot end. In this nates zone, the ribs form with the longitudinal center line an angle $\delta>90°$ towards the foot end, so that in this nates zone, too, the depicted arrow shape is realized but points towards the foot end. The angle $\delta$ thereby is preferably smaller than the angle $\alpha$; in other words, the arrow shape in the nates zone is not as marked as it is in the dorsal zone.

The angle $\delta$ preferably is 91° up to 120°, and in particular 91° up to 110°.

By means of the range indications 95° up to 120° for the angle $\alpha$, and 91° up to 120° for the angle $\delta$, all intermediate values and in particular the individual values are moreover also disclosed. Thus, the range 90° up to 120° for the angle $\alpha$ is at least representative of the individual values 95°, 96°, 97°, 98°, 99°, 100°, 101°, 102°, 103°, 104°, 105°, 106°,107°, 108°, 109°, 110°, 111°, 112°,113°, 114°, 115°, 116°, 117°, 118°, 119° and 120°, while the range 91 $^0$up to 120° for the angle $\delta$ is at least representative of the individual values 91°, 92°, 93°, 94°, 95°, 96°, 97°, 98°, 99°, 100°, 101°, 102°, 103°, 104°, 105°, 106°, 107°, 108°, 109°, 110°, 111°, 112°, 113°, 114°, 115°, 116°, 117°, 118°, 119° and 120°. In addition, all narrower ranges falling into the larger range indications are thereby covered and disclosed.

The separation between the dorsal zone and the nates zone thereby is effected in a purposeful manner on the level of the lumbar vertebrae zone of the person to be rested. In this lumbar vertebrae zone, additional ribs can also be present inclined neither towards the head end nor towards the foot end but extending perpendicular to the bottom part and/or running perpendicular to the longitudinal center line.

The height of the ribs, also in this embodiment, can decrease in the dorsal zone from approximately the center, for one, towards the head end, and, for another, towards the foot end (to be more precise, the buttocks end).Thus, the contour of the dorsal zone and the ribs, respectively, is better adapted to that of the vertebral column.

The inventive support can be combined with therefrom separated arm supports and/or lower leg supports, and also with a cervical support, and constitutes then the core element of said support system. The arm supports and the lower leg supports thereby are equipped with ribs corresponding to those present in the nates zone of the inventive support. The lower leg supports thereby have additional ribs preferably on that side, as well, which rests upon the ground, which ribs are inclined into the direction opposing that of the ribs in the support zone (i.e. that zone, in which the legs lie upon the lower leg support). Thus, an increased tension is exerted on the legs.

The cervical support preferably has an approximately semi-cylindrical bottom part, from which the ribs extend approximately in the radial direction. One could also say that the cervical support constitutes a "half roll". This cervical support is placed onto the inventive support in the zone of the person to be rested.

The ribs in the costal zone, as well as in the nates zone, and also the ribs of the arm supports, the lower leg supports and the cervical support, can have, at their free edge, a lobe approximately extending in parallel to the bottom part, for example lobes of the kind described and illustrated as "flanges 2" in GB 2197785A. Then, said lobe extends approximately horizontal in the support, the arm supports and the lower leg supports.

These lobes are preferably situated on that end of the support from which the ribs incline away. When the ribs hence are inclined towards the head end in the dorsal zone, then the ribs preferably extend towards the foot end. In the nates zone, where the ribs are inclined towards the foot end, the ribs preferably extend towards the head end. Yet, it is also possible that the rib lobes extend into that direction towards which the ribs are inclined. In addition, the ribs can also have two lobes of that kind on their free edge, one of which extending towards the head end, and the other towards the foot end, for example of the type shown in U.S. Pat. No. 5,007,124 at the upper ends of the ribs 18.

DESCRIPTION OF THE DRAWINGS

The inventive support is explained in more detail in the following by means of the drawings illustrating the preferred embodiments. These drawings show.

DETAILED DESCRIPTION OF THE PREFERRED EMBODIMENTS

Figure 1:
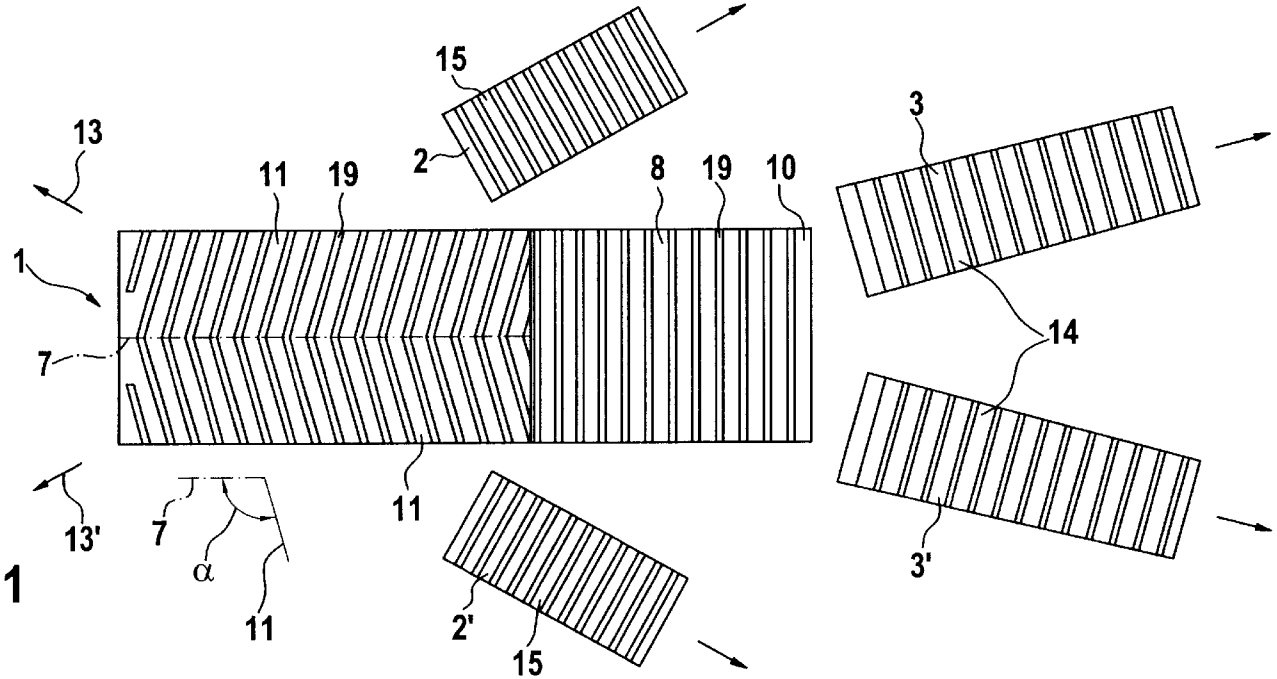
FIG. 1 a top view from above onto an inventive support completed by two arm supports and two lower leg supports to form a support system, FIG. 2 a view in a longitudinal cut of the support shown in FIG. 1 and of the lower leg support likewise shown therein, FIG. 3 a top view of an inventive support in the form of a dorsal rest, FIG. 4 a longitudinal cut through the dorsal rest shown in FIG. 3, FIG. 5 a top view of another embodiment of a support for a lying person, FIG. 6 a longitudinal cut through the support shown in FIG. 5, FIG. 7 a perspective view of a lower leg support, FIG. 8 a perspective view of an arm support, FIG. 8 a perspective view of a cervical support, and FIG. 10 a top view corresponding to FIG. 5 of a further, in particular preferred embodiment of the support for a lying person.
Figure 2:
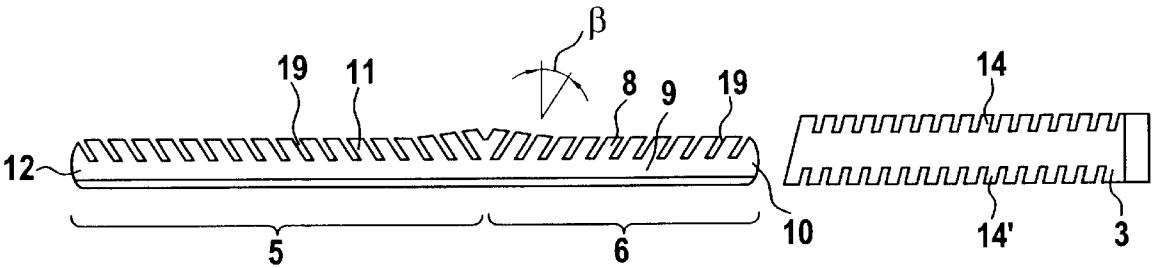

The support 1 shown in FIG. 1 constitutes an orthopedic or therapeutic mat for resting a person in the lying position. This support 1 is subdivided into a dorsal zone 5 and a nates zone 6 (cf. FIG. 2). In the nates zone 6, the support 1, viewed from above, has ribs 8 running transversely and perpendicular, respectively, to the longitudinal center line 7, which ribs extend upwards from the bottom part 9.

These ribs 8, as seen in the side view, are inclined towards the foot end 10. In other words, the plane of these ribs 8 that extends transversely to the longitudinal center line 7, is inclined by an angle $\beta$ (cf. FIG. 2) to the perpendicular towards the foot end. This angle $\beta$ preferably makes up 20° to 35°, and in particular about 27°. Between the ribs 8, a gap or interspace 19 is realized. The configuration of the inventive support in the nates zone 6 thereby corresponds to the state of the art.

In the dorsal zone 5, the ribs 11, in the side view, are likewise inclined by the mentioned angle $\beta$, however, towards the head end 12. In the dorsal zone 5, as well as in the nates zone 6, the angle $\beta$, starting from the ribs 8,11 situated in the center zone, where the dorsal zone 5 abuts against the nates zone 6, can increase towards the ribs 8, 11 situated at the foot end 10 and the head end 12, respectively.

The dorsal zone 5 thereby is subdivided into two zones by the longitudinal center line 7, namely into a left and a right zone. In each of these zones, the ribs 11 are arranged in parallel to each other and form with the longitudinal center line 7, viewed from above, an angle $\alpha$, such as the latter is outlined in FIG. 1. This angle $\alpha$ is larger than 90°, and is about 116° in the embodiment shown.

The ribs 11 in the dorsal zone 5 form, viewed from above, a kind of arrow, the head of which is situated on the longitudinal center line and points towards the head end 12. Between the individual ribs 11, a gap or interspace 19 is likewise present.

When a person is placed onto the support shown in FIG. 1, then a stretching force is exerted on said person's body, whereby the force resultant points into the direction of the arrows 13 and 13', respectively. The right zone of the dorsal zone 5 thereby "pulls" into the direction of the arrow 13, whereas the left zone "pulls" into the direction of the arrow 13'.

The support 1 shown in FIG. 1 is completed by arm supports 2, 2' and lower leg supports 3, 3' to form a support system, and constitutes the core element thereof. The ribs 14 of the lower leg support 3 thereby are configured alike the ribs 8 of the support 1 in the nates zone 6, which ribs 8 run perpendicular to the longitudinal center line 7. However, the lower leg support 3, on that side which rests upon the ground, features further ribs 14', which are shaped alike the ribs 14 but are inclined into the opposing direction. The ribs 14 thereby are inclined towards the feet, whereas the ribs 14' are inclined towards the head.

The ribs 15 of the arm supports 2 and 2', respectively, likewise correspond to the ribs 8 of the support 1 in the nates zone 6, and are inclined towards the foot end. The height of the arm support 2 and 2', respectively, thereby decreases from the head end towards the foot end, such as can in particular be seen from FIG. 2.

Figure 5:
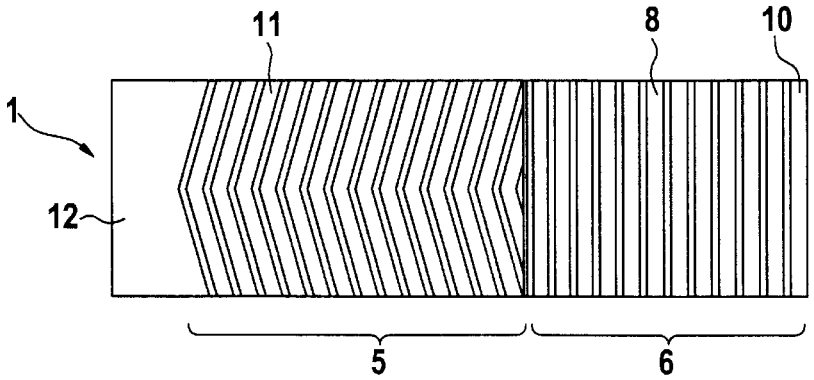
Figure 6:
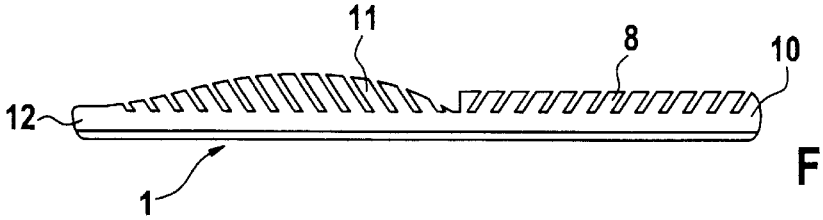
Figure 7:
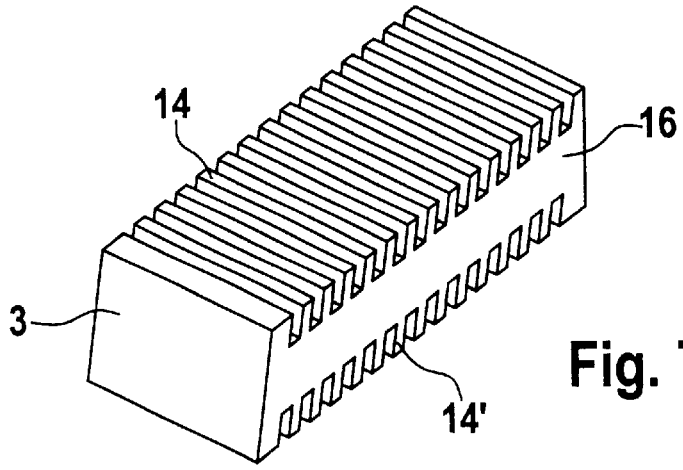
Figure 8:
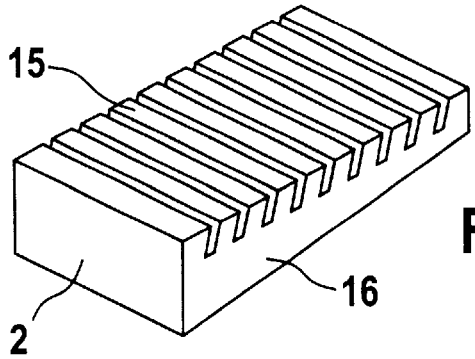

The support 1 shown in the FIGS. 5 and 6 primarily distinguishes from the support shown in FIG. 1 in that the height of the ribs 11 in the dorsal zone 5 varies. Thus, the height of these ribs 11 is largest in the center and decreases towards the foot end 10, as well as towards the head end 12, so that the shape of a flat elevation arises in the side view, the contour of which approximately corresponds to a person's dorsal contour.

Figure 3:
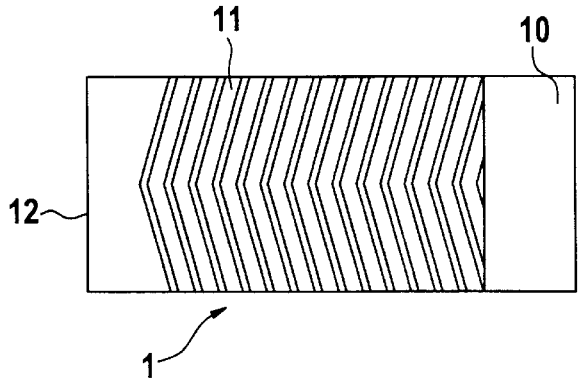
Figure 4:
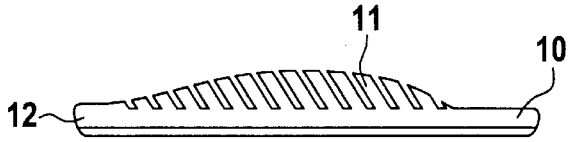

The support 1 illustrated in the FIGS. 3 and 4, represents a dorsal rest for a seated person quasi having only one dorsal zone. The ribs 11 of this support 1, with respect to their arrow-shaped arrangement, correspond to the ribs 11 of the support shown in FIG. 1 in the dorsal zone 5. In addition, the height of these ribs 11 decreases from the center towards the two ends 10,12, as it is described in conjunction with FIG. 6.

Figure 10:
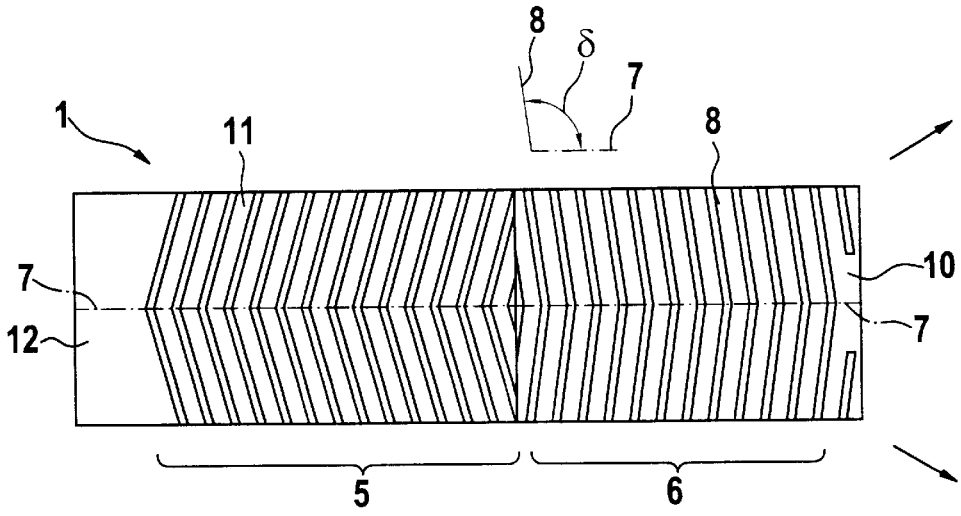

The support 1 shown in FIG. 10 has a dorsal zone 5 corresponding to the dorsal zone 5 of the support 1 shown in FIG. 5. However, the support 1 shown in FIG. 10 has a nates zone 6, which distinguishes from the nates zone 6 of the support 1 shown in FIG. 5. The difference resides in that the ribs 8 in the nates zone 6 are likewise arranged in an arrow shape, the arrow, however, pointing towards the foot end 10. Moreover, the angle $\delta$ of these ribs 8 can be smaller than the angle $\alpha$ of the ribs 11 in the dorsal zone 5. The support 1 shown in FIG. 10 thereby represents the embodiment preferred in particular, which is combined in an advantageous manner with the arm supports 2, 2' and the lower leg supports 3, 3' shown in FIG. 1.

Figure 9:
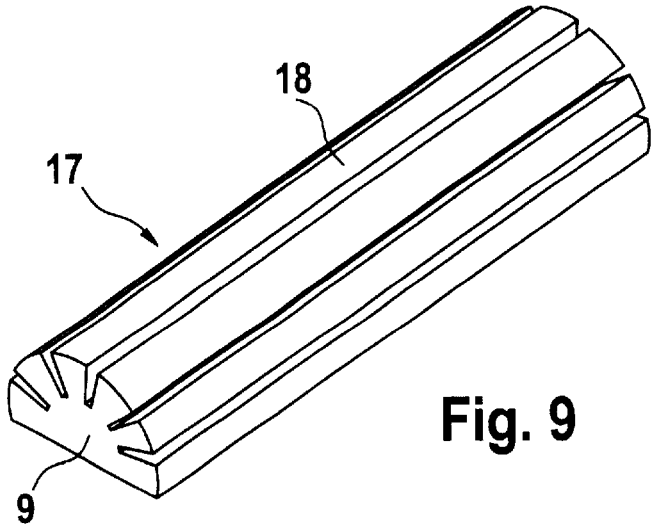

The cervical support shown in FIG. 9 has a semi-cylindrical bottom part 9 from which ribs 18 extend radially towards the outside.

All of the ribs 8, 11, 14, 15 and 18 can be equipped at their upper free edge with lobes extending in parallel towards the bottom part, which lobes correspond to the prior art and therefore are not shown in the Figures in more detail.

The support 1, the arm supports 2, 2', the lower leg supports 3, 3', and the cervical support 17 can be made from a permanently flexible material, for example a foam material of a known kind.

List of Reference Numerals

1 support
2, 2' arm support
3, 3' lower leg support
4 dorsal rest
5 dorsal zone
6 nates zone
7 longitudinal center line
8 ribs of the support in the nates zone
9 bottom part
10 foot end
11 ribs of the support in the dorsal zone
12 head end
13, 13' arrows
14, 14' ribs of the lower leg support
15 ribs of the arm support
16 bottom part
17 cervical support
18 ribs of the cervical support
19 gap/interspace

What is claimed is:

1. A support for the body of a lying or sitting person, comprising a formed structure of a permanently flexible material in the form of an orthopedic or therapeutic mat, said structure including a bottom part that has a head end and an opposing foot end, and from which several ribs arranged side-by-side protrude towards the upper side running approximately transversely to the longitudinal center line of the support and being inclined, viewed from a side thereof, towards the head end and wherein said ribs are arranged in an arrow shape, and form with the longitudinal center line an angle $\alpha$ larger than 90° towards the head end, said support being subdivided into a dorsal zone, in which the ribs form with the longitudinal center line an angle $\alpha$ larger than 90° towards the head end, and a nates zone, in which several ribs are disposed in a side-by-side arrangement protruding from the bottom part and being inclined towards the foot end, and the direction of running of said ribs in the nates zone being selected from the group consisting of perpendicular to the longitudinal center line, and arranged in an arrow shape, forming with the longitudinal center line an angle $\delta$ larger than 90° towards the foot end.

2. The support according to claim 1, wherein said angle $\alpha$ of the successive ribs increases towards the head end.

3. The support according to claim 1, wherein said angle $\alpha$ of all ribs is of equal size, and the ribs run in parallel to each other on each side of the longitudinal center line.

4. The support according to claim 1, in the form of a dorsal rest for a seated person, and wherein the height of the successive ribs decreases towards the two ends.

5. The support according to claim 4, wherein said support comprises a support system, and wherein the support system, in addition to said support for a body, also comprises therefrom separated arm supports and/or lower leg supports equipped with ribs which protrude from the bottom part and are inclined towards the foot end, and run perpendicular to the longitudinal center line.

6. The support according to claim 5, wherein said lower leg supports also comprise on that side of the bottom part which rests upon the ground, additional ribs, which are inclined in the direction opposing that of said ribs that protrude from the bottom part and are inclined towards the foot end.

7. The support according to claim 5, including a cervical support that has an approximately semi-cylindrical bottom part from where ribs extend approximately in the radial direction.

8. The support according to claim 1, wherein said angle $\delta$ is 91° up to 120° and/or said angle $\alpha$ is 95° up to 120°.

9. The support according to claim 8, wherein the separation between the dorsal zone and the nates zone is located at the level of the lumbar vertebrae zone of a person to be supported.

10. The support according to claim 9, including additional ribs in the lumbar vertebrae zone which are not inclined but extend perpendicular to the bottom part and/or run perpendicular to the longitudinal center line.

11. The support according to claim 1, wherein said ribs, on their free edge, have a lobe extending approximately parallel to the bottom part.

12. The support according to claim 11, wherein said lobes extend towards that end of the support from which the ribs extend away.

13. The support according to claim 11, wherein said ribs, on their free edge, have two lobes extending approximately horizontally and approximately parallel to the bottom part, one of said lobes extending towards the head end and the other towards the foot end.

* * * * *